US005601138A

United States Patent [19]

Di Giusto et al.

[11] Patent Number: 5,601,138

[45] Date of Patent: Feb. 11, 1997

[54] METHOD FOR THE CONTROLLED PRE-ROLLING OF THIN SLABS LEAVING A CONTINUOUS CASTING PLANT, AND RELATIVE DEVICE

[75] Inventors: Bruno Di Giusto; Fulvio Fasano; Wogler Ruzza, all of Udine; Mirco Striuli, San Dona' Di Piave; Alfredo Lavazza, Solbiate Olona; Andrea Carboni, Milan; Giovanni Coassin, Pordenone, all of Italy

[73] Assignee: Danieli & C. Officine Meccaniche SpA, Buttrio, Italy

[21] Appl. No.: 553,015

[22] Filed: Nov. 3, 1995

Related U.S. Application Data

[63] Continuation of Ser. No. 177,765, Jan. 4, 1994, Pat. No. 5,488,987, which is a continuation-in-part of Ser. No. 963, 734, Oct. 20, 1992, abandoned.

[30] Foreign Application Priority Data

Oct. 31, 1991 [IT] Italy ..... UD91A0184
May 17, 1993 [IT] Italy ..... UD93A0083

[51] Int. Cl.[6] ..... B22D 11/16; B22D 11/12

[52] U.S. Cl. ..... 164/452; 164/476; 164/417; 164/424; 164/154.1

[58] Field of Search ..... 164/452, 417, 164/476, 424, 441, 442, 484, 454, 154.1

[56] References Cited

U.S. PATENT DOCUMENTS 4,955,428 9/1990 Schrewe ..... 164/417
5,018,569 5/1991 Burau et al. ..... 164/454
5,058,656 10/1991 Hoffken et al. ..... 164/417

FOREIGN PATENT DOCUMENTS 62-130759 6/1987 Japan ..... 164/454

*Primary Examiner*—Joseph J. Hail, III
*Assistant Examiner*—I.-H. Lin
*Attorney, Agent, or Firm*—Antonelli, Terry, Stout & Kraus, LLP

[57] ABSTRACT

Method for the controlled pre-rolling of thin slabs (20) leaving a continuous casting plant, whereby the pre-rolling is carried out with a plurality of pairs of rolls (14–16), a first pre-rolling assembly (10) being positioned immediately downstream of foot rolls (12) of a mold (11), at least one displaceable roll (16) being included in the pairs of rolls (14–16), the pairs of rolls (14–16) being associated with pressure transducer (18) and hydraulic capsule (17), position transducer (24) being included. The pressure transducer (18) and position transducer (24) can be associated with a data processing unit (21), at least the first of the pairs of rolls (14–16) processing a slab (20) which has just emerged from the mold (11) with a thin solidified skin. The method achieves a pre-rolling with a reduction of the thickness of the slab (20) leaving the last pair of pre-rolling rolls (14–16) by at least 10% so as to eliminate the liquid core and to bring into contact the zones in a two-phase condition in order that the central solidification structure be refined and the central separation be minimized. Device suitable to carry out the controlled pre-rolling of thin slabs according to the above method, which comprises an element (25*a*) to monitor the temperature of the liquid bath in a tundish, an element (25*b*) to monitor the temperature of a slab (20), an element (26) to monitor the speed of the slab (20) and an element (28) to monitor the inclusion of a liquid cone.

30 Claims, 2 Drawing Sheets

METHOD FOR THE CONTROLLED PRE-ROLLING OF THIN SLABS LEAVING A CONTINUOUS CASTING PLANT, AND RELATIVE DEVICE

CROSS REFERENCE TO RELATED APPLICATION

This is a continuation of application Ser. No. 08/177,765, filed Jan. 4, 1994 and now issued as U.S. Pat. No. 5,488,987, which is a continuation-in-part of application Ser. No. 07/963,734, filed Oct. 20, 1992, now abandoned.

BACKGROUND OF THE INVENTION

This invention concerns a method for the controlled pre-rolling of thin slabs leaving a continuous casting plant, and the relative device.

To be more exact, this invention concerns a method and relative device for controlled pre-rolling, carried out on thin slabs leaving a mold for the continuous casting of thin slabs, immediately downstream of the foot rolls of that mold and concerns also the device suitable to apply that method.

By thin slabs are meant slabs 800 to 2500 mm. wide, or more, and 25 to 90 mm. thick.

The invention is applied advantageously, but not only, to slabs having a final thickness between 30 and 60 mm. at the outlet of the continuous casting machine.

The invention can also be applied to the continuous casting of billets, whether the billets be round, square, rectangular, etc.

The invention can be applied to straight and curved continuous casting plants.

Pre-rolling methods are known whereby a thin slab undergoes a pre-rolling action in a zone distant from the foot rolls.

In the methods of the state of the art disclosed in JP-A-130759, U.S. Pat. No. 3,891,025, U.S. Pat. No. 4,056,140 and U.S. Pat. No. 4,134,440 the pre-rolling does not give satisfactory results inasmuch as it is performed in a position of the slab such that the livid core or pool is only seldom still present and the skin of the slab is anyway already thick and is such that it cannot be readily deformed.

Moreover, the skin of one side of the slab is connected to the skin of the other side by columnar solidification elements at an intermediate position between the edges; both the edges, which contain a consistent solidified thickness, and also the columnar solidification elements offer a strong resistance to any alteration of the thickness of the slab.

The pre-rolling in the methods of the state of the art, therefore, has only a marginal and very limited effect, which does not give the envisaged results.

Moreover, the pre-rolling as carried out in the methods of the state of the art has only the purpose of performing a marginal superficial work, and the real work of reducing the thickness of the slab is entrusted to the rolling train located downstream.

Furthermore, in the pre-rolling assemblies of the state of the art only some pairs of rolls are controlled to check the pre-rolling parameters, and these pairs of rolls are controlled in a differentiated or separate manner (see JP-A-130759). This has the result that the operating method cannot be conditioned according to specific requirements but is quite random in some ways.

Pre-rolling assemblies are also known which comprise mechanical adjustment systems together with pre-adjustment at the beginning of a casting campaign. These assemblies are associated with pre-rolling rolls in continuous rows or divided into sectors or groups of rolls or else with assemblies of pressure belts.

These systems of the state of the art do not mike possible excellent adjustments, nor a substantial pre-rolling action of a desired value, nor a continuously controlled travel continuously related to the actual pre-rolling requirements. They also do not enable processing to be carried out on a zone where the liquid core or pool is still substantial and the surface skin is still of very small values.

The state of the art prevents controlled mechanical action to reduce the length of the liquid cone and thus to ensure better quality.

Moreover, the state of the art entails considerable limitations with regard to problems linked to the transient conditions of starting and stopping and does not permit an excellent yield of the system.

The state of the art does not obviate the flow of liquid material at start-up and the re-flow of the liquid metal at stopping and therefore keeps the reject rate high.

SUMMARY OF THE INVENTION

The present applicants have examined, tested and achieved this invention so as to overcome the shortcomings of the state of the art and to provide further advantages.

The pre-rolling method according to the invention can be performed advantageously with a pre-rolling assembly of the type disclosed herein and in EP-A-0.539.784 corresponding to U.S. patent application Ser. No. 07/963,734, filed Oct. 20, 1992, the contents of which are incorporated herein by reference.

The purpose of this invention is to achieve a controlled pre-rolling or soft reduction of the slab leaving the crystallizer so as to produce a slab of a smaller thickness at the end of the casting machine.

The main advantages of the controlled pre-rolling, or soft reduction, or reduction with a liquid core or pool are essentially two; the first advantage is to be able to produce at the outlet of the casting machine a slab of a slender thickness (30–60 mm.) by using a crystallizer having a greater thickness, that is to say, the short side of the lengthwise through passage of the crystallizer has a greater width than the finished thickness of the slab after the controlled pre-rolling.

This controlled pre-rolling improves the fluid-dynamic behavior of the liquid metal in the crystallizer of the mold; it also improves the life of the submerged nozzle assembled on the tundish and improves the behavior during melting of the powders which are placed above the upper part of the liquid metal in the mold.

The second advantage is the achievement of a refining of the structure of solidification of the metal and the elimination of the central segregation in the slab.

In both cases, the soft reduction, if it is to be effective, has to take place with a continuous controlled reduction of the thickness of the slab, and this can be achieved with a substantially conical conformation of the segment of slab undergoing the soft reduction.

This conical segment can have a length ranging from about 0.8 to 7 meters, preferably 3.8 meters to 6.3 meters; the greater length corresponds to the end of the containing zone produced by the containing rolls included downstream of the crystallizer and after the foot rolls.

The length of this segment of reduction of the thickness with a conical development depends on the following metallurgical factors.

The solidification takes place in a substantially different manner with different types of steel; steels with a low content of carbon (C less than 0.10%) have a solidification characterized by short columnar grains and the solidification face moves forward in a compact condition without great discontinuities and with a short two-phase zone.

Steels with a high carbon content (C greater than 0.70%) have a solidification characterized by long columnar grains and the solidification face moves forward with great discontinuities, creating a grid of large dendrites, among which there remain islands of segregated liquid steel. In this case the two-phase zone is very extensive.

The moment when the two faces of solidification (upper side and lower side of the slab) meet is very critical moment for the definition of the internal quality and, more generally, of the finished quality of the slab.

In fact it is known that owing to the effect of bulging (swelling of the slab between two opposed pairs of containing rolls), an effect of pumping the segregated liquid is created; this bulging effect may be restricted but is never fully eliminated.

When the slab opens owing to the bulging effect, the liquid between the dendrites is sucked back by the cavities between the dendrites towards the center line of the slab.

When the slab closes on passing through the next pair of rolls, the liquid is pumped in the opposite direction from the center line to the cavities between the dendrites.

This alternating pumping effect creates islands of positive and negative segregation at the center line of the slab.

So as to prevent this continuous to-and-fro flow of the segregated liquid, it is necessary to try to close the passages between the dendrites and between one grain and the next grain by means of compacting the structure at the solidification face.

This can be achieved by compressing the two halves of the slab against each other by means of a light rolling of the slab producing a substantially conical development of the reduction.

Owing to the different extent of the two-phase zone produced in the various types of steel, the compression has to take place in such a way that the two solidification faces penetrate into each other with different degrees according to the type of steel.

Steels with a low content of carbon and a short two-phase zone have to penetrate into each other by a few millimeters to a depth where the solid fraction is consistent (about 90–95%) and the small spaces between the dendrites are already practically nil.

Steels with a high content of carbon and a long two-phase zone have to penetrate into each other in a consistent manner to a depth where the solid fraction is less (up to 70%) and the spaces between the dendrites are very extensive.

The best solid fraction at the end of the reduction depends, therefore, on the type of steel and can be thus summarized by bearing in mind a variation of the solid fraction upwards or downwards of 2 to 2.5%, depending on metallurgical factors.

| C content (%) | Solid fraction (%) |
|---|---|
| <0.20 | 95 |
| 0.20–0.4 | 90 |
| 0.40–0.70 | 80 |
| >0.70 | 70 |

Where soft reduction is carried out, this means that the end of the conical segment of reduction of the thickness of the slab has to take place in a zone where the solid fraction is best for obtaining a good internal quality.

Let us assume that it is desired to obtain at the end of the casting machine a slab with the thickness of 30 mm., starting with a short side of 50 mm. of the crystallizer of the mold and assuming also that steel is of a C 70 type.

The reduction to be carried out is 20 mm. (50–30).

Having valuated the profile of solidification of the slab at the current casting conditions, it is necessary to determine at what distance from the level of the meniscus of the liquid metal in the crystallizer of the mold there exists in the slab leaving the crystallizer a solid fraction of 70% at a distance of 15 mm. from the surface (15 being the half of 30).

Let us suppose that this distance from the meniscus is 4 meters.

If the crystallizer is 1.2 meters long, the soft reduction has to have a length (Lsr) of:

Lsr=4 minus 1.2=2.8 meters and the gradient of reduction (Gsr) has to be:

Gsr=(50 minus 30)=20 mm./2.8 meters=7.143 mm./m.;

that is to say, for each meter of slab outside the crystallizer it is necessary to apply a reduction of thickness of 7.143 mm.

The pre-rolling method therefore consists in a model of ON LINE solidification which determines the exact profile of solidification of the slab on the basis of the current casting conditions.

This model calculates the length of the pre-rolling —Lsr— that is to say, the position along the machine where a desired solid fraction exists at a depth from the surface equal to the half-thickness of the slab to be produced.

Having defined this level, the conical segment of the reduction is adjusted by rolling in such a way is to have a gradient of reduction—Gsr—such as will bring the end of the reduction to the calculated pre-rolling length Lsr.

This result is achieved by reducing in a controlled, desired manner the length of the liquid cone or pool, thus minimizing the occurrence of segregation found in unalloyed steels with a medium-high content of carbon, or alloyed steels with a medium-low content of carbon, or in steels in general which entail the occurrence of segregation.

This desired, controlled reduction of the length of the liquid cone enables the mushy zone to be kept in contact, eliminating the liquid phase in such a way as to promote the growth of an equiaxe structure such as that which can be produced with electromagnetic stirring.

A further purpose of the pre-rolling method according to the invention is to speed up the formation of crystals and therefore the formation of stable columnar connections between the skin of one side and the skin of the other side of the slab.

In the method according to the invention these columnar connections are formed in a compressed environment owing to the pre-rolling action exerted by the pre-rolling assembly, so that these connections are produced already compacted with a typical arrangement.

This leads to the advantage that the product leaving the continuous casting plant arrives more compact at the rolling line and with a substantially smaller thickness and better levelled.

By carrying out a dynamic control of the length of the liquid cone or pool as a function of the main casting parameters (speed, superheating in the tundish, secondary cooling downstream of the mold and steel grade), the invention also enables the transient periods of starting and stopping (at the end of casting or owing to an accident) to be optimized and the scrap to be reduced.

Moreover, the method according to the invention makes possible the casting in a mold of a slab having a section of a greater thickness then the final one with all the advantages in terms of surface quality arising from optimization of the working conditions of the lubricating powder (greater melting surface, regularity of the covering of the powders on the liquid steel), of superheating of the steel and of downflow in the mold (with less turbulence and greater stability of the meniscus), and also makes possible the use of a submerged nozzle having a greater cross-section and therefore more longlasting.

This pre-rolling method enables the outgoing cross-section of the slab to be reduced so as to be able to reach smaller final thicknesses, given an equal number or rolling units.

According to the invention the pre-rolling rolls positioned on the outer curved side of the plant, in the event of continuous curved casting, can be associated with load cells, which control the pressure which those rolls exert on the thin slab.

The pre-rolling rolls positioned on the inner curved side of the plant are associated with a hydraulic capsule, for instance of the type disclosed in EP-0444420, and may also be associated with load cells as an alternative to those envisaged for the rolls on the outer curved side.

A pressure transducer is included on each hydraulic capsule and enables the rolling pressure to be controlled.

According to the invention the pairs of rolls are arranged in one or more groups, each group forming a pre-rolling assembly. Each pre-rolling assembly includes a stationary portion and a displaceable portion. This description assumes as an example that the outer curved side contains stationary rolls while the displaceable rolls form the inner curved side, but in practice the two sides can also be inverted.

According to a variant the inner and outer curved sides may include a stationary portion and a displaceable portion, which cooperate with a displaceable portion and a stationary portion of the opposite side respectively.

According to a first lay-out of the invention each pair of rolls is associated with a single position transducer, which monitors the distance between the opposed rolls.

In a second lay-out of the invention each group of pairs of rolls forming a pre-rolling assembly includes two transducers monitoring the position of that assembly, these transducers being located respectively at the upstream and downstream ends of that pre-rolling assembly and monitoring the distance between the opposed rolls at those positions.

According to a variant of this second lay-out each pair of rolls is also associated with a single position transducer.

By means of the position transducers it is possible to determine in the pre-rolling assemblies a rolling passage between the pairs of rolls; this passage may have its sides parallel or converging, depending on the particular requirements.

Moreover, if each pair of rolls is associated with a single position transducer, it is possible to determine a pre-rolling passage having a lengthwise section of any particular form by positioning each roll of each pair of rolls as required.

The whole system is governed by a pre-rolling control and data processing unit, which receives signals from the pressure transducers and position transducers, whether single or belonging to assemblies, and also from monitors of the speed of the slab, from monitors of the secondary cooling parameters and from monitors of the temperature of the cast molten metal and of the temperature of the thin slab leaving the mold.

Further temperature monitors may also be included which monitor the temperature of the slab at intermediate positions in the area where the pre-rolling assembly according to the invention is working, and which send signals to the pre-rolling control and data processing unit.

Furthermore, a monitor, possibly of the sonar type for instance, may be included to identify the presence or absence of a liquid pool within the slab and thus to ensure correctly the actual closure of the liquid cone or pool in the pre-rolling assembly according to the invention.

The control and data processing unit, which may be connected to or form part of other general control and data processing units, processes all these parameters and compares them with the pre-rolling parameters fed into or contained in appropriate internal files and provides the pairs of rolls with optimum adjustment values.

The control and data processing unit may also be connected to an auxiliary data collection unit, which, besides recording all the values provided by the monitors, feeds them to a data bank able to display and/or print the progress of the values over a period of time.

In this description, by rolls are meant rolls positioned in continuous rows or divided into sectors, or else belts, etc., thus covering any system of the state of the art.

The adjustments which are carried out with the method according to the invention are adjustments of single rolls, or of one assembly of rolls at a time followed by another assembly and so on, or general adjustments of the whole pre-rolling assembly. The adjustments may be added algebraically.

The pre-rolling method according to the invention enables a reduction of the thickness of the slab by between about 10% and 50% to be achieved. This reduction of the thickness is obtained in a travel between 0.8 and 7 meters long, but advantageously between 1.2 and 1.8 meters long.

The reduction of the thickness of the slab may be progressive with constant values.

According to a variant the reduction of the thickness of the slab is carried out in steps, with a final finishing segment in which the reduction of thickness is progressive.

According to a variant means for the secondary cooling of the slab are associated with the pre-rolling assembly according to the invention and consist, for instance, of a plurality of sprayer nozzles.

Both the rate of flow and the delivery pressure of the sprayer nozzles are adjusted advantageously by the data processing and control unit and/or by the general data processing and control unit, thus ensuring a continuous control of the condition of the slab.

The regulation of the sprayer nozzles may be governed by possible monitors of the temperature of the slab, these monitors being arranged along the pre-rolling assembly.

According to another variant at least one descaling unit of the type shown in patent application IT-UD92AOOO129 filed in the name of the present applicants, for instance, may be associated with the pre-rolling assembly according to the invention. This descaling unit installed upstream of the first pre-rolling assembly enables thin slabs to be produced with an excellent surface quality as required for special successive processing.

According to a variant a plurality of descaling units are included and are placed between the pairs of pre-rolling rolls.

According to yet another variant the descaling units are placed between each pair of pre-rolling rolls.

According to a further variant and particularly where descaling units are positioned between the pairs of pre-rolling rolls, the rolls are cooled inside to prevent the scale removed from the surface of the thin slabs from adhering to the surface of the roll itself.

BRIEF DESCRIPTION OF THE DRAWINGS

The attached figures are given as a non-restrictive example and show some preferred lay-outs of the invention as follows.

DETAILED DESCRIPTION OF THE PREFERRED EMBODIMENTS

In the figures the pre-rolling method according to the invention is carried out by at least one pre-rolling assembly 10 consisting of a plurality of pairs of rolls 14–16.

Figure 1:
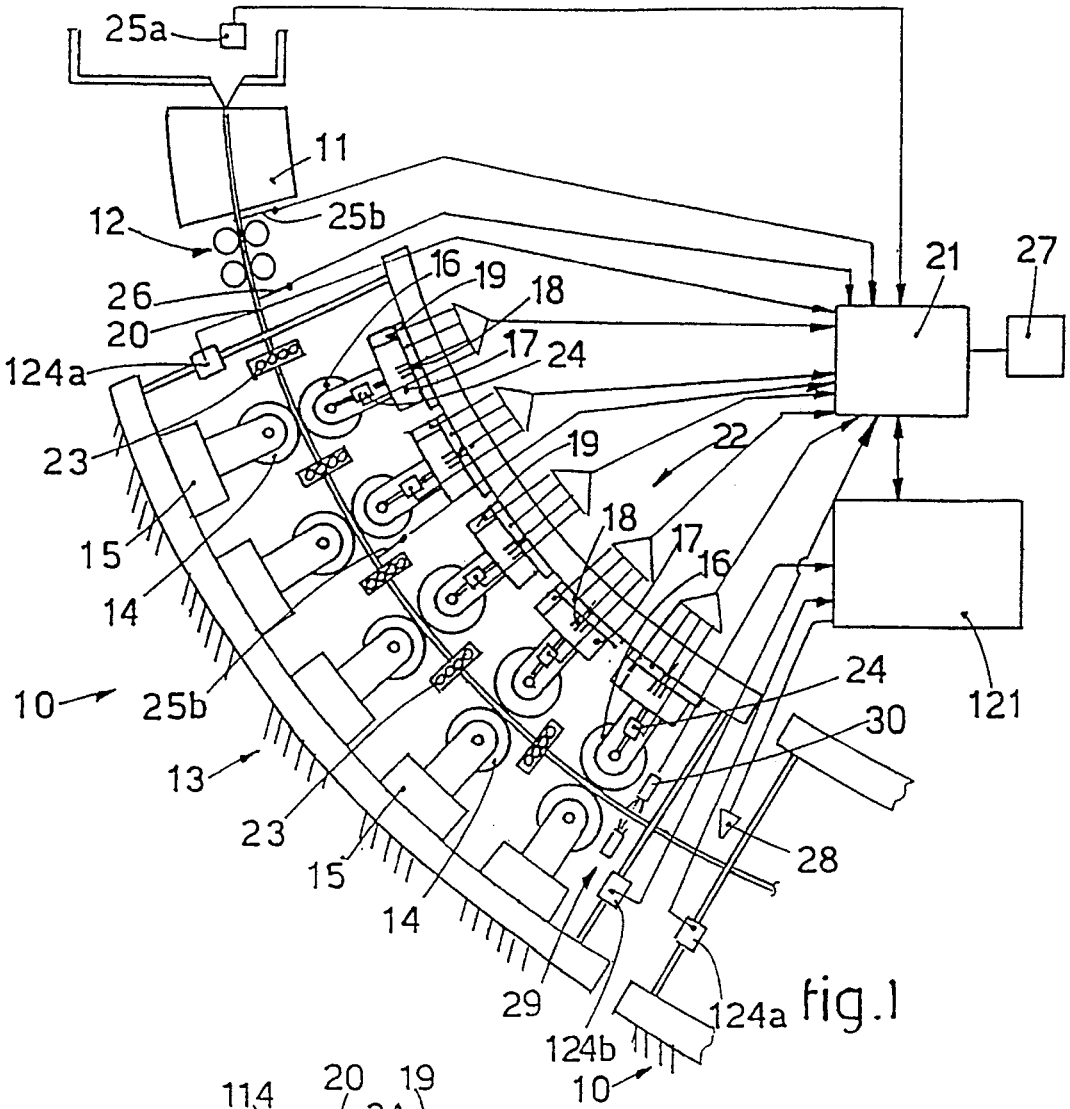
FIG. 1 is a diagram of one side of an assembly for the pre-rolling of thin slabs produced by continuous curved casting according to the invention.

FIG. 1 shows only the first of these pre-rolling assemblies 10 in association with foot rolls 12 and a mold 11, which produces a thin slab 20 continuously, a second pre-rolling assembly 10 installed immediately downstream being shown only partly.

The first pre-rolling assembly 10 is installed immediately downstream of the mold 11 at a distance of about 0.5 meters.

Figure 2:
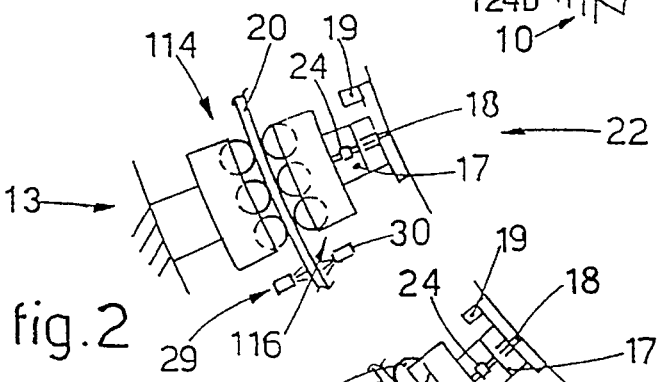
FIGS. 2 and 3 show two other possible types of pre-rolling rolls.
Figure 3:
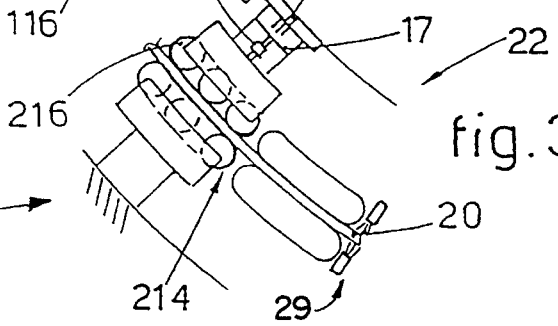

The pairs of rolls 14–16 shown may consist of continuous rows or be divided into sectors 14–16 or into groups of two or more pairs 114–116 (FIG. 2) or consist of belts 214–216 (FIG. 3) or be of any other known type.

In the example shown the outer curved side 13 of the assembly 10 is the stationary or fixed part or frame, while the inner curved side 22 of the assembly 10 is the displaceable or loose part or frame of the pre-rolling assembly 10.

The rolls 14–114 and 214, and the other rolls disclosed in a variant, of the outer curved side 13 may be associated singly or in groups with at least one load cell 15, which sends signals to a control and data processing unit 21 of the pre-rolling device.

In the form of embodiment shown in FIG. 1 the rolls 16–116 and 216, and the other rolls disclosed in a variant, of the inner curved side 22 are associated singly or in groups with at least one hydraulic capsule or cylinder 17.

Each hydraulic capsule 17 is controlled by a servovalve 19 and is associated with a pressure transducer 18. The servovalves 19 are controlled by the control and data processing unit 21 of the pre-rolling device.

Figure 4A:
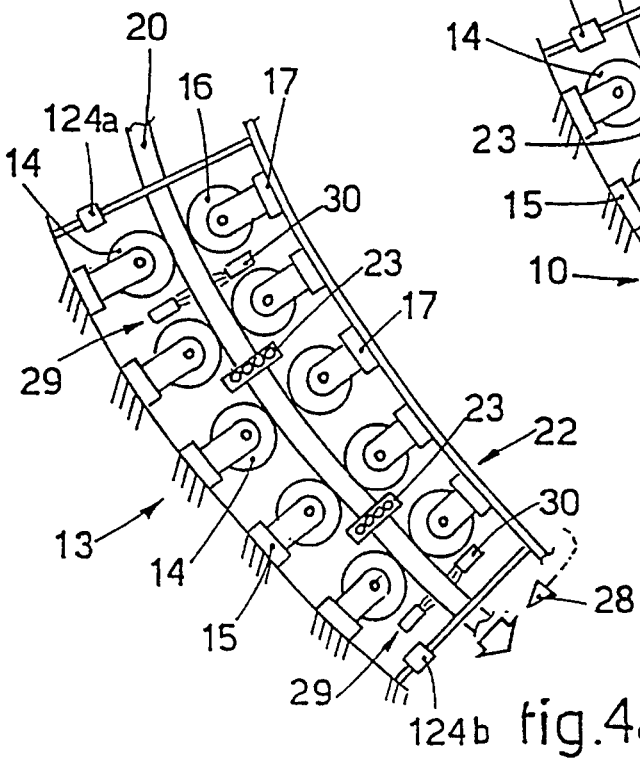
FIGS. 4*a* and 4*b* are diagrams of two possible positions of the pre-rolling assembly of FIG. 1.
Figure 4B:
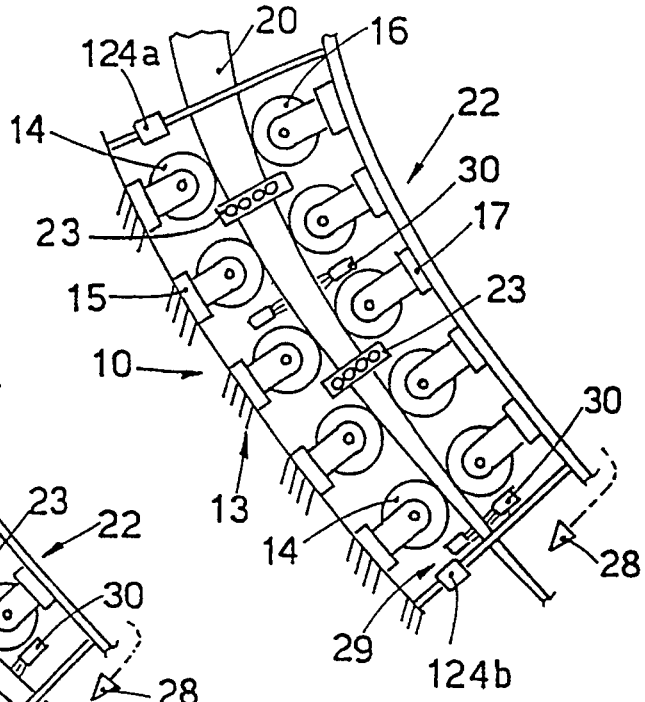

In this example each pair of rolls 14–16 is associated with an individual position transducer 24, and each pre-rolling assembly 10 is associated with two transducers 124 monitoring the position of the assembly and arranged respectively at the upstream end 124*a* and downstream end 124*b* of the pre-rolling assembly 10.

Where two assembly position transducers 124, namely an upstream position transducer 124*a* and a downstream position transducer 124*b*, respectively, are associated with the pre-rolling assembly 10, it is possible to determine between the pairs of rolls 14–16 a rolling passage with parallel (FIG. 4*a*) or converging (FIG. 4*b*) walls.

In this example the assembly position transducers 124 are installed between the stationary outer curved side 13 and the displaceable inner curved side 22 of the pre-rolling assembly 10.

According to a variant which is not shown here the assembly position transducers 124 are associated only with the displaceable inner curved side 22 of the pre-rolling assembly 10.

Each pressure transducer 18, each individual position transducer 24 and each assembly position transducer 124 send their own signals to the control and data processing unit 21 and possibly receive control and checking signals.

The parameters linked to the pre-rolling to be carried out and possibly associated with the type of material cast and with the dimensions of the thin slab 20 are set or introduced in the control and data processing unit 21 at the beginning of a rolling campaign.

The control and data processing unit 21 pre-arranges the pairs of rolls 14–16, 114–116, 214–216 and, when casting has started and the starter bar has been withdrawn, controls and adjusts the pairs of rolls 14–16, 114–116, 214–216 one by one so that the desired pre-rolling takes place.

So as to regulate and control the pre-rolling in order to achieve a desired, controlled reduction of the thickness of the slab 20, means 25*a* to monitor the temperature of the cast molten metal and to monitor the temperature of the metal in the tundish, means 25*b* to monitor the temperature of the thin slab 20 leaving the mold 11 and means 26 to monitor the speed of the slab 20 are associated with the control and data processing unit 21 according to the invention.

All these monitoring means 25*a*, 25*b* and 26 send their signals to the control and data processing unit 21, thus enabling a dynamic control of the pre-rolling method to be carried out as a function of the speed of the slab 20 and ensuring a more correct management of the transient conditions of starting and stopping.

According to a variant a plurality of auxiliary monitors 25*b* of the temperature of the slab 20 may be included and be positioned along the pre-rolling assembly 10 so as to control the development of the temperature of the slab 20 at pre-set points.

In this case the control and data processing unit 21 is connected to a general control and data processing unit 121 and to a unit 27 which introduces and collects data.

The control and data processing unit 21 and/or the general control and data processing unit 121, which control adjustments, condition on the basis of a governing and control program set by the machine operator, for instance, the reciprocal positions of the rolls of the pairs of rolls 14–16 forming the pre-rolling assembly 10.

This control and adjustment system enables the thickness of the slab 20 to be reduced between 10% and 50%.

According to a variant means 29 for secondary cooling of the slab 20 are associated with the pre-rolling assembly 10 according to the invention and consist in this case of a plurality of sprayer nozzles 30.

Both the rate of flow and the pressure of delivery of these sprayer nozzles 30 are regulated advantageously by the control and data processing unit 21 and/or by the general control and data processing unit 121, thus ensuring a continuous control of the conditions of the slab 20.

The regulation of the sprayer nozzles 30 may be governed by the possible monitors 25*b* of the temperature of the thin slab 20 which are arranged along the pre-rolling assembly 10.

According to a variant at least one monitor 29 of a sonar type, for instance, is associated with the pre-rolling assembly 10 according to the invention so as to identify the point of actual closure (kissing point) of the liquid cone within the slab 20. This at least one monitor 28 is connected advantageously to the general control and data processing unit 121 so as to regulate the secondary cooling means 29.

To give an example, it is possible with the pre-rolling method according to the invention to reduce the thickness of a slab 20 moving at a casting speed of 4.5 meters per minute from a value of 70–75 mm. to 50 mm. in a travel between 0.8 and 2.5 meters long, but advantageously between 1.2 and 1.5 meters long.

Depending on the program set in the control and data processing unit 21, or 121, the reduction of thickness can be progressive with constant values or be in steps, but advantageously with a final finishing segment in which the reduction is progressive.

In this example a descaling device 23 is fitted downstream of the foot rolls 12 so as to produce a thin slab 20 having an excellent surface quality and has the purpose of removing the layer of oxides formed on the surface of the slab 20 immediately upstream of the pre-rolling assembly 10 according to the invention.

According to a variant more than one descaling device 23 may be included and be installed between one pair of rolls 14–16 and the next pair.

According to another variant the pairs of rolls 14–16 associated with the descaling devices 23 include means for the internal cooling of the pre-rolling rolls 14–16, for instance by internal circulation of a cooling fluid; the purpose of this is to prevent the scale removed by the descaling devices 23 from the surface of the slab 20 from adhering to the surface of the rolls owing to the high temperature, thus making necessary frequent maintenance and cleaning operations to keep the working surface of the rolls perfectly smooth.

Figure 5:
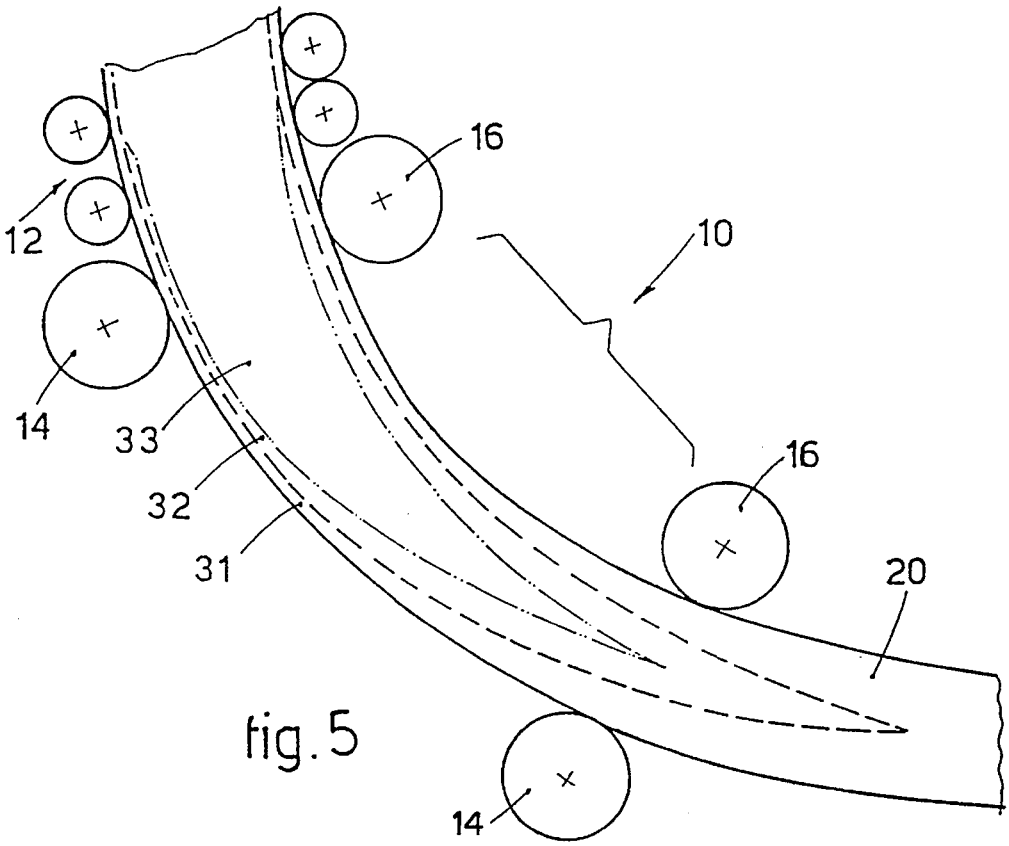
FIG. 5 shows the formation of the two-phase zone according to the invention.

FIG. 5 shows how the skin 31 increases progressively and how at the same time the two-phase zone 32 too, which forms in a substantial manner owing to the pressure exerted by the pre-rolling assembly 10, is progressively reinforced and is closed before the slab 20 has left the pre-rolling assembly 10, so that the cone or pool of the liquid metal 33 remains surrounded within the pre-rolling assembly 10.

We claim:

1. An assembly for the controlled pre-rolling of thin slabs leaving a continuous casting mold including foot rolls, the assembly being positioned a short distance from the mold and immediately downstream of the foot rolls of the casting mold such that the slab passing through the assembly has a liquid core, the assembly having at least one segment, each segment comprising:

a stationary sector provided adjacent a first major surface of the slab and comprising a plurality of rolls; and a movable sector provided adjacent a second major surface of the slab and comprising a plurality of rolls associated with at least one hydraulic capsule governed by a servovalve for positioning the rolls of the movable sector.

2. An assembly as claimed in claim 1, wherein the plurality of rolls of the stationary sector are associated with at least one load cell.

3. An assembly as claimed in claim 2, in which each hydraulic capsule is associated with a transducer indicating pressure and position.

4. An assembly as claimed in claim 3, in which the load cell, the servovalves and the pressure and position transducers are associated with a control and data processing unit comprising means for the insertion/introduction of the pre-rolling parameters and the characteristics of a liquid core of the slab.

5. An assembly as claimed in claim 1, wherein the rolls of each of the stationary sector and moveable sector are continuous.

6. An assembly as claimed in claim 1, wherein the rolls of each of the stationary sector and moveable sector consist of individual segments.

7. An assembly as claimed in claim 1, wherein the rolls of each of the stationary sector and moveable sector support an endless belt.

8. An assembly as claimed in claim 1, wherein each of the rolls of the moveable sector is associated with a hydraulic capsule governed by a servovalve.

9. An assembly as claimed in claim 1, wherein the rolls of the moveable sector are arranged in groups, each group being associated with a hydraulic capsule governed by a servovalve.

10. An assembly as claimed in claim 1, wherein the assembly is positioned at a distance of about 0.5 meters from the mold.

11. A combination of a continuous casting mold including foot rolls for producing thin slabs having liquid cores, and an assembly for the controlled pre-rolling of thin slabs leaving the continuous casting mold, the assembly being positioned a short distance from the mold and immediately downstream of the foot rolls such that the slab passing through the assembly has a liquid core, the assembly having at least one segment, each segment comprising:

a stationary sector provided adjacent a first major surface of the slab and comprising a plurality of rolls; and a movable sector provided adjacent a second major surface of the slab and comprising a plurality of rolls associated with at least one hydraulic capsule governed by a servovalve for positioning the rolls of the movable sector.

12. A combination as claimed in claim 11, wherein the plurality of rolls of the stationary sector are associated with at least one load cell.

13. A combination as claimed in claim 12, wherein said assembly is positioned with respect to said foot rolls and has a length such that the thin slab leaving said assembly contains a not completely solidified core.

14. A combination as claimed in claim 11, herein the assembly is positioned at a distance of about 0.5 meters from the mold.

15. A combination of a continuous casting mold for producing thin slabs having liquid cores, and an assembly for the controlled pre-rolling of thin slabs leaving the continuous casting mold, the assembly being positioned at a distance of about 0.5 meters downstream of the mold such that the slab passing through the assembly has a liquid core, the assembly having at least one segment, each segment comprising:

a stationary sector provided adjacent a first major surface of the slab and comprising a plurality of rolls; and a movable sector provided adjacent a second major surface of the slab and comprising a plurality of rolls associated with at least one hydraulic capsule governed by a servovalve for positioning the rolls of the movable sector.

16. A combination as claimed in claim 15, wherein the plurality of rolls of the stationary sector are associated with at least one load cell.

17. A combination as claimed in claim 16, wherein said assembly is positioned with respect to said mold and has a length such that the thin slab leaving said assembly contains a not completely solidified core.

18. A method for the controlled pre-rolling of a thin slab leaving a continuous casting mold including foot rolls, comprising:

withdrawing the thin slab from said foot rolls of said continuous casting mold while the thin slab has a liquid core; and then immediately passing the thin slab between pairs of rolls of a stationary sector and of an opposed movable sector of at least one pre-rolling assembly positioned a short distance from the mold and immediately downstream of said foot rolls while the thin slab has a liquid core, said stationary sector comprising a plurality of rolls and said movable sector comprising a plurality of rolls associated with at least one hydraulic capsule governed by a servovalve for positioning the rolls of the movable sector; and positioning the rolls of the movable sector to achieve a controlled pre-rolling of the thin slab having a liquid core.

19. A method as claimed in claim 18, wherein the plurality of rolls of the stationary sector are associated with at least one load cell.

20. A method as claimed in claim 18, wherein a length of said pre-rolling assembly and said positioning of said movable sector is controlled to achieve a reduction in thickness of the thin slab of about 10% to 50%.

21. A method as claimed in claim 18, wherein a length of said pre-rolling assembly and said positioning of said movable section is controlled such that the thin slab leaving said pre-rolling assembly contains not completely solidified core.

22. A method as claimed in claim 21, wherein a solid fraction of the thin slab leaving said pre-rolling assembly is about 67.5% to 97.5%.

23. A method as claimed in claim 21, wherein the thin slab leaving said pre-rolling assembly has a central core having a two-phase condition to thereby refine a central solidification structure and minimize central separation.

24. A method as claimed in claim 18, wherein said at least one pre-rolling assembly is positioned at a distance of about 0.5 meters from said mold.

25. A method for the controlled pre-rolling of a thin slab leaving a continuous casting mold, comprising:

withdrawing the thin slab from said continuous casting mold while the thin slab has a liquid core; and then immediately passing the thin slab between pairs of rolls of a stationary sector and of an opposed movable sector of at least one pre-rolling assembly positioned at a distance of about 0.5 meters downstream of said mold while the thin slab has a liquid core, said stationary sector comprising a plurality of rolls and said movable sector comprising a plurality of rolls associated with at least one hydraulic capsule governed by a servovalve for positioning the rolls of the movable sector; and positioning the rolls of the movable sector to achieve a controlled pre-rolling of thin slab having a liquid core.

26. A method as claimed in claim 25, wherein the plurality of rolls of the stationary sector are associated with at least one load cell.

27. A method as claimed in claim 25, wherein a length of said pre-rolling assembly and said positioning of said movable sector is controlled to achieve a reduction in thickness of the thin slab of about 10% to 50%.

28. A method as claimed in claim 25, wherein a length of said pre-rolling assembly and said positioning of said movable section is controlled such that the thin slab leaving said pre-rolling assembly contains not completely solidified core.

29. A method as claimed in claim 28, wherein a solid fraction of the thin slab leaving said pre-rolling assembly is about 67.5% to 97.5%.

30. A method as claimed in claim 28, wherein the thin slab leaving said pre-rolling assembly has a central core having a two-phase condition to thereby refine a central solidification structure and minimize central separation.

* * * * *